US006336842B1

(12) United States Patent
Ootsuki et al.

(10) Patent No.: US 6,336,842 B1
(45) Date of Patent: Jan. 8, 2002

(54) ROTARY MACHINING APPARATUS

(75) Inventors: Shigeo Ootsuki, Kasama; Shigeo Moriyama, Tama; Takashi Kugaya, Hitachinaka; Kenichi Togawa; Makoto Kajiwara, both of Mito; Shyuichi Oowada; Yukio Suzuki, both of Hitachinaka; Yoko Sugawa, Yono, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/574,285

(22) Filed: May 19, 2000

(30) Foreign Application Priority Data

May 21, 1999 (JP) ..... 11-141137

(51) Int. Cl.[7] ..... B24B 49/00

(52) U.S. Cl. ..... 451/21; 451/8; 451/9; 451/177; 451/259; 451/443

(58) Field of Search ..... 451/8, 9, 21, 177, 451/259, 443

(56) References Cited

U.S. PATENT DOCUMENTS 5,975,994 A * 11/1999 Sandhu et al. ..... 451/56

6,120,349 A * 9/2000 Nyui et al. ..... 451/21

FOREIGN PATENT DOCUMENTS

| | | |
|---|---|---|
| JP | 7-9325 | 1/1995 |
| JP | 10-128653 | 5/1998 |
| WO | WO 97/10613 | 3/1997 |

* cited by examiner

*Primary Examiner*—Joseph J. Hail, III
*Assistant Examiner*—Shantese McDonald
(74) *Attorney, Agent, or Firm*—Kenyon & Kenyon

(57) ABSTRACT

An object of the present invention is to provide a polishing apparatus which is capable of configuring a surface of a polishing tool without damaging the polishing tool.

In order to solve the above-mentioned problem, the present invention provide a rotary machining apparatus comprising a polishing tool for polishing a sample; a rotary disk for holding the polishing tool; a tool for configuring a surface of the polishing tool; and a position adjusting mechanism for adjusting a gap between the tool and the polishing tool, which comprises a rotating mechanism for rotating the tool; and a sensor for sensing a change in the rotation of the rotating mechanism, a height at starting to configure the polishing tool using the tool being determined based on the change in the rotation obtained by the sensor.

8 Claims, 3 Drawing Sheets

ROTARY MACHINING APPARATUS

BACKGROUND OF THE INVENTION

The present invention relates to a rotary machining apparatus for polishing a surface such as a semiconductor substrate and, more particularly to a rotary machining apparatus having a function to remove asperities on a surface of a polishing tool for polishing a semiconductor substrate.

A semiconductor manufacturing process is composed, of various kinds of processing processes. As the needs of higher speed processing and higher density for semiconductor devices are growing in recent years, the trend of the circuit elements is accelerated to move toward multilayered structures. The trend of the multilayered structure of the circuit elements causes a problem in that a step is formed on a boundary between a region having a circuit element formed and a region having no circuit element on a semiconductor substrate, and the step is increased higher every time the layer is overlaid. As a result, when mask exposure is performed in the photo-lithography process, there are some cases that the depth of focus exceeds or etching becomes difficult to be performed in the upper layer side.

In order to solve the above-mentioned problems, technologies to flatten the surface of semiconductor substrate. As the flattening technology for the purpose known is a chemical mechanical polishing (CMP) technology in which an abrasive (slurry), which suspends abrasive particles such as alumina or silica particles in hydrogen peroxide or the like, is let flow on a soft or viscoelastic polishing pad, the polishing pad is rotated, and a silicon wafer or the like is pushed against the polishing pad to polish the surface of the wafer.

However, the technology has problems that the surface can not sufficiently flattened depending on the kind of pattern or the condition of step because the soft or viscoelastic polishing pad is used, and that the consumable cost becomes large because the slurry liquid is always let flow.

A polishing apparatus is disclosed in W097/10613. The polishing apparatus solves the above-mentioned problems using a grinder composed of grinding particles and a binding resin for binding the grinding particles.

A polishing tool used for flattening a semiconductor substrate is required to have higher flatness as it becomes harder. The reason is that in comparing with a soft polishing tool, existence of asperities on the polishing surface of the hard polishing tool unevenly, not flat, polishes a semiconductor substrate to be polished, or on the contrary the polishing tool is sometimes broken by applying a concentrated pressure to a specified portion of the polishing tool during polishing.

A technology to form a surface of a polishing tool into an arbitrary shape is disclosed in Japanese Patent Application Laid-Open No.7-9325. The patent discloses a moving mechanism which comprises a tool for forming a surface of a polishing tool into an arbitrary shape, and moves the tool toward arbitrary directions.

Such a tool is likely to be broken when the tool is pushed against a polishing tool with a strong force, or when the polishing tool is polished in excessively large depth. Particularly, this tendency becomes more pronounced as the polishing tool is harder. Therefore, polishing (configuring) is necessary to be started by bringing the tool close to a position not to damage the polishing tool. However, the polishing apparatus disclosed in Japanese Patent Application Laid-Open No. 7-9325 is not sufficient in this point.

SUMMARY OF THE INVENTION

An object of the present invention is to provide a polishing apparatus which is capable of configuring a surface of a polishing tool without damaging the polishing tool. Further, another object of the present invention is to provide a polishing apparatus which is capable of reducing process time for polishing the surface of the polishing tool.

In order to solve the above-mentioned problem, the present invention provide a rotary machining apparatus comprising a polishing tool for polishing a sample; a rotary disk for holding the polishing tool; a tool for configuring a surface of the polishing tool; and a position adjusting mechanism for adjusting a gap between the tool and the polishing tool, which comprises a rotating mechanism for rotating the tool; and a sensor for sensing a change in the rotation of the rotating mechanism, a height at starting to configure the polishing tool using the tool being determined based on the change in the rotation obtained by the sensor.

By constructing as described above, contact between the tool and the polishing tool is sensed from a change in rotation of the tool, and the height at starting to configure the polishing tool using the tool can be determined by the contact point.

The other construction in accordance with the present invention will be further described later in the section of DESCRIPTION OF THE PREFERRED EMBODIMENTS.

DESCRIPTION OF THE PREFERRED EMBODIMENTS

Figure 1:
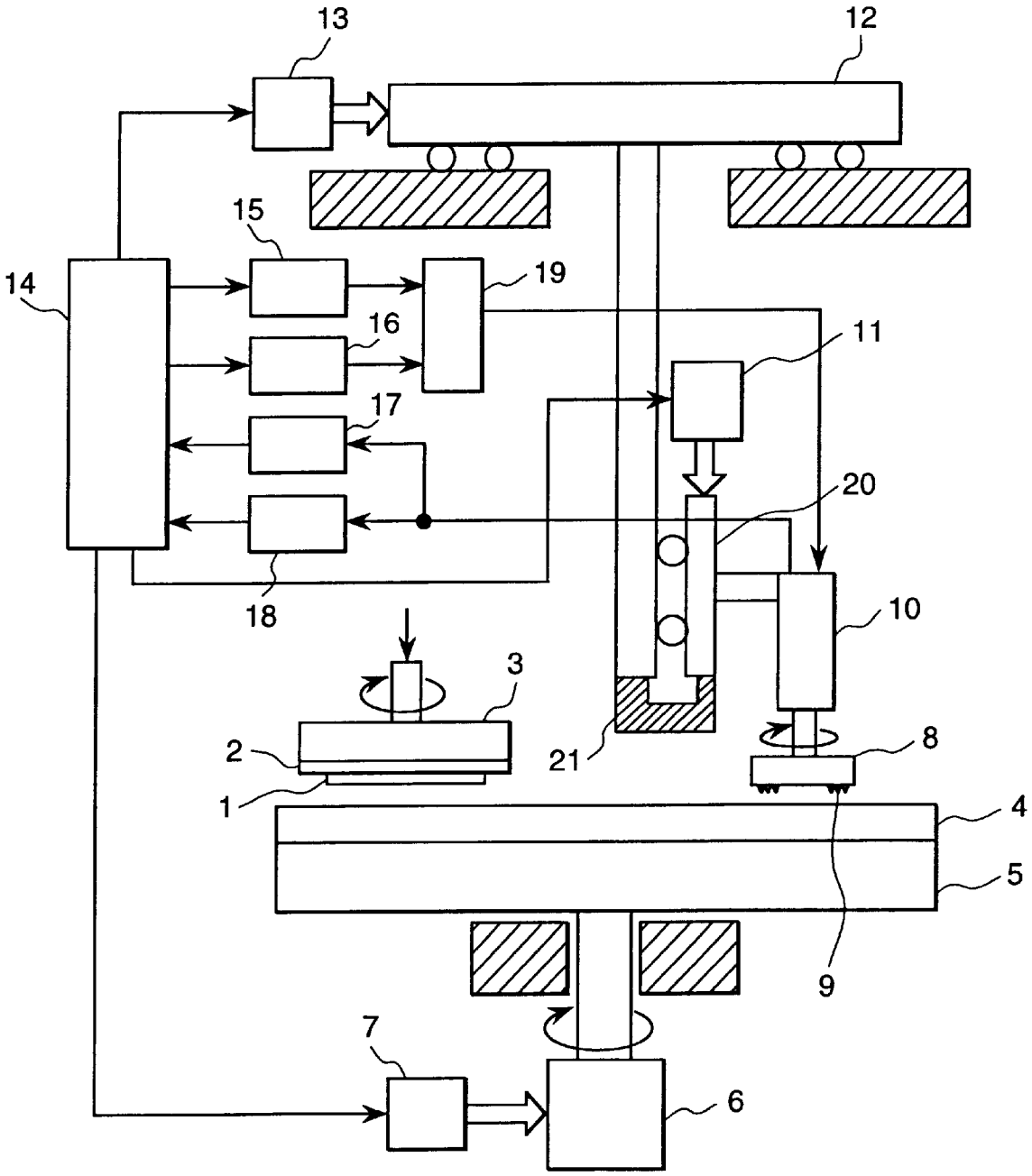
FIG. 1 is a view explaining a method in accordance with the present invention.

An embodiment of an apparatus in accordance with the present invention will be described in detail below, referring to FIG. 1. The present embodiment is an example of a semiconductor wafer flattening apparatus to which the present invention is applied. The semiconductor wafer flattening apparatus is strongly required a highly accurate and economical machining method which can perform in a short time, with a high efficiency, and without machining damage.

A wafer polishing grindstone 4 (polishing tool) is used for polishing and flattening a surface of a wafer substrate 1 (sample) which is three-dimensionally formed in order to highly integrate a semiconductor element. Therein, the wafer polishing grindstone 4 has an elasticity of 5 to 500 $kg/mm^2$. That is, the wafer polishing grindstone 4 is 1/10 to 1/100 times softer than an ordinary grindstone used in the other field, and on the contrary, 5 to 50 times harder than a polishing pad made of a hard polyurethane commonly used in the CMP. Description will be made below on the rotary machining apparatus using the wafer polishing grindstone having the elasticity of 5 to 500 $kg/mm^2$. However, the present invention is not limited to the wafer polishing grindstone having such a hardness, and the present invention can be applied to the rotary machining apparatus comprising a polishing pad or a wafer polishing grindstone having various hardness.

The wafer polishing grindstone 4 is composed of grind particles for polishing and resin for binding the grind particles. As for kind of the grind particles, silicon dioxide, cerium oxide, aluminum oxide are preferable, and the grind particles having a grain size of 0.01 to 0.1 $\mu$m can attain a preferable high efficiency without occurrence of scratches.

As for the resin for binding the grind particles, a high purity organic group resin such as a phenol group resin, a polyester group resin is preferable. The grindstone is fabricated by mixing the grind particles with the binding resin, then applying an appropriate pressure to the mixture to solidify it, and performing treatments such as heat curing, if necessary.

The wafer polishing grindstone 4 fabricated as such a manner is fixed on a faceplate 5 (rotating disk). A wafer substrate 1 is fixed onto a wafer holder 3 through a holding pad 2 having elasticity. The wafer substrate 1 is disposed opposite to the wafer polishing grindstone 4. The surface of the wafer substrate 1 is polished and flattened by being pushed against the surface of the wafer polishing grindstone 4 with applying a load while the wafer holder 3 is being rotated and supplying pure water or the like onto the surface to remove projecting portions in an insulator film on the surface of the wafer substrate 1.

As the wafer polishing grindstone 4 is being used, teeth of the grindstone are filled with ground dust or the surface of the wafer polishing grindstone is deformed. If the apparatus in such states is used, the ability of polishing the wafer substrate 1 is deteriorated or the surface of the wafer substrate can not be appropriately flattened. Therefore, honing of the surface of the wafer polishing grindstone 4 or correction of the surface such as configuration of the whole surface is performed at appropriate intervals or in parallel with polishing of the wafer substrate. This machining needs to be performed in a short time and efficiently without less machining damage.

The apparatus of the present embodiment comprises a grindstone 8 (tool) for performing such machining. The honing and the surface configuration of the wafer polishing grindstone is performed using the grindstone 8. The operation will be described below.

Initially, the wafer polishing grindstone 4 is rotated in a state of being fixed onto the faceplate 5. Rotating speed of the face plate 5 can be variably controlled by a faceplate rotating motor 6, a faceplate rotating motor control part 7 and a controller 14. The grindstone 8 is arranged in the direction perpendicular to the wafer polishing grindstone 4.

The grindstone 8 is a machining tool having grinding particles 9 such as diamond particles or ceramic particles buried in the cutting edge of the grindstone. The grindstone 8 is driven by a spindle motor 10 (rotating mechanism) and rotated at a high rotating speed of, for example, 10000 rpm to precisely machine a workpiece such as the wafer polishing grindstone 4 rotating at a rotating speed of, for example, approximately 10 rpm with a cutting rate in $\mu$m order.

A control part of the spindle motor 10 is composed of two blocks. The first one is a torque control part 15 used for detecting a contact point between the wafer polishing grindstone 4 and the grindstone 8, and the second one is a speed control part 16 used for the actual machining. Further, the control part of the spindle motor 10 comprises a load current detector 17 and a speed detector 18 which acquire control information from the spindle motor 10.

The spindle motor 10 is mounted on a Z-direction moving table 20, and is movable in the Z-axis direction in the figure, that is, in the cutting direction by being moved by a Z-direction drive system 11 (position adjusting mechanism). A position of the Z-direction moving table 20 is accurately detected by a Z-position detector 21 and transmitted to the controller 14.

Further, movement in the X-direction of the Z-direction moving table 20 is restricted on an X-direction moving table 12 which is horizontally moved in the X-direction by an X-direction drive system 13. Therefore, the grindstone 8 can be moved straight in the radial direction of the wafer polishing grindstone 4 with keeping a feeding quantity in the Z-direction constant. A feeding quantity of the grindstone 8 is determined by a positioning coordinate of the Z-direction moving table 20 and given by an instruction of the controller 14.

In the explanation on the apparatus of the embodiment in accordance with the present invention, the moving mechanism for moving the grindstone 8 in the Z-direction is provided, but it is not limited to the above construction. For example, it is possible that a moving mechanism toward the Z-axis direction is provided to the faceplate 5, and the relative position between the grindstone 8 and the wafer polishing grindstone 4 is adjusted by moving the faceplate 5 in the Z-axis direction.

In the grindstone 8 in the apparatus of the embodiment in accordance with the present invention, the pushing force is not controlled, but the position in the Z-direction of the Z-direction moving table is controlled. By controlling the position of the grindstone 8 appropriately, it is possible to solve the bad effect that an excessively large pressure is applied onto the polished surface of the wafer polishing grindstone 4 or that asperities on the polished surface insufficiently removed.

A specific means for appropriately controlling the position in the Z-direction of the grindstone 8 will be described below. The time when correction of the surface configuration of the polishing surface of the wafer polishing grindstone 4 is the time when the wafer polishing grindstone 4 is exchanged for a new one.

Just after changing the wafer polishing grindstone 4, the surface configuration is sometimes uneven and different from one by one though the average thickness is not different so much. In order to correct the surface configuration to the wafer polishing grindstone 4 in such a state while the position of the grindstone 8 is being appropriately controlled, in the apparatus of the embodiment in accordance with the present invention, contact between the wafer polishing grindstone 4 and the grindstone 8 is sensed at first and a position in the Z-direction of the grindstone 8 at that time is sensed.

In the apparatus of the present embodiment, in order to sense the contact between the grindstone 8 and the wafer polishing grindstone 4, the change in rotating speed of the spindle motor 10 is sensed by the speed detector 18. For sensing the change in rotating speed, a rotating speed detecting means such as an encoder is used. A position of the Z-direction moving table 20 at the time when a change in rotating speed is recognized is detected by the Z position detector 21. A position of the grindstone 8 based on the position of the Z-direction moving table 20 becomes a point of starting configuring (a configuring height) to the wafer polishing grindstone 4.

By controlling the quantity of movement of the moving mechanism based on a predetermined value of the cutting quantity (the machining depth) by detecting the position in the Z-direction, it is possible to solve the bad effect that an excessively large pressure is applied onto the polished surface of the wafer polishing grindstone 4 or that asperities on the polished surface insufficiently removed. Therein, it is not always necessary that the point of starting configuring is made agree with the contact sensed position. For example, the point of starting configuring may be set at a point slightly higher than the height of the grindstone 8 where the contact is sensed, and vice versa.

In the apparatus of the present embodiment, sensing of the contact between the wafer polishing grindstone 4 and the grindstone 8 or sensing of the configuring height of the grindstone 8 is performed based on the change in rotating speed of the spindle motor 10, as described above. Otherwise, the contact between the wafer polishing grindstone 4 and the grindstone 8 may be detected using an optical sensor or the like provided at a position near the both grindstones. However, since the wafer polishing grindstone 4 and the grindstone 8 are worn as they are used, it is difficult to match the position with the optical sensor and accordingly the optical sensor is not suitable for detecting the configuring height.

In another way, it can be considered that the contact between the wafer polishing grindstone 4 and the grindstone 8 may be sensed by sensing a reaction force against the pushing force in the Z-direction of the grindstone 8. However, there is the following problem when comparing with the technology that the contact is sensed based on the change in the rotating speed as in the apparatus of the embodiment in accordance with the present invention. The grindstone 8 employed in the apparatus of the embodiment in accordance with the present invention has diamond particles or ceramic particles buried in the cutting edge of the grindstone, as described above. The grindstone 8 is rotated by the spindle motor 10 as if these diamond particles or the like scratch the wafer polishing grindstone 4. In the apparatus of the embodiment in accordance with the present invention, since the grindstone 8 is moved close to the wafer polishing grindstone 4 by the Z-direction moving table 20 while the spindle motor is being rotated, a change in rotating speed is sensed when the diamond particles catch the wafer polishing grindstone 4 and accordingly response of sensing the contact is good.

On the other hand, it is difficult to sense the reaction force based on the contact of the diamond particles or the like. Because the reaction force can not be sensed until the organic group resin portion holding the diamond particles or the like collides with the wafer polishing grindstone 4, and accordingly there is a problem in that response of sensing the contact is worse compared to the sensing of the change in rotating speed.

In a further way, it can be considered that the contact between the wafer polishing grindstone 4 and the grindstone 8 may be sensed by sensing a change in the load current of the spindle motor 10. However, it is difficult to sense the contact based on a very small change in the load current because the current value is always fluctuated due to torque ripple or the like. That is, the change in rotation can not be sensed unless the change in current is sufficiently larger than the torque ripple.

As described above, in the apparatus of the present embodiment, a change in the rotating speed of the spindle motor is sensed in order to perform the sensing of the contact with high accuracy.

Figure 2:
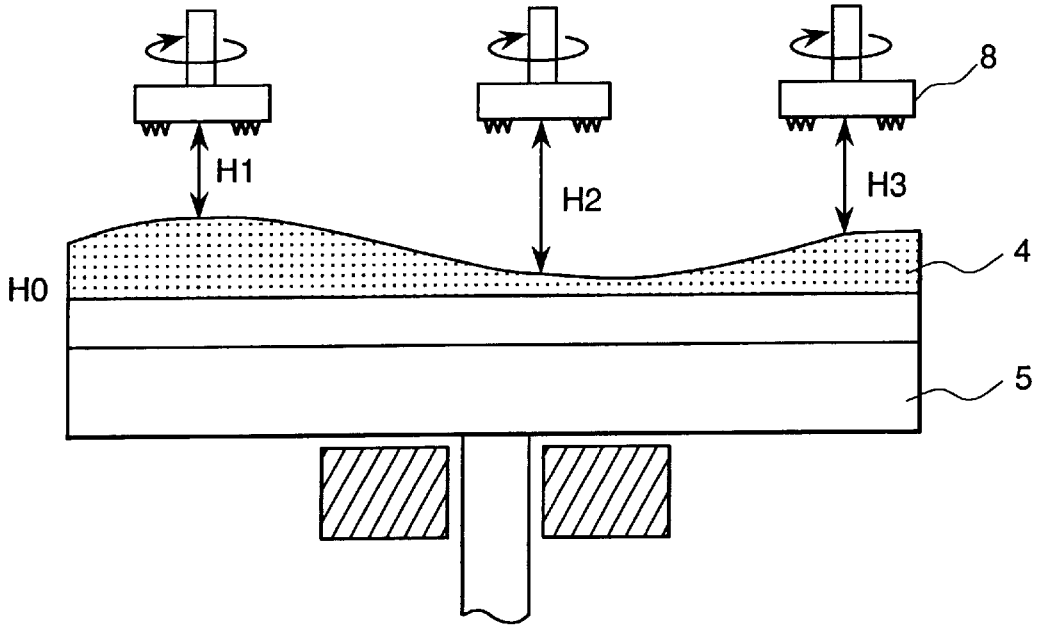
FIG. 2 is a view explaining a surface configuration of a wafer polishing grindstone in accordance with the present invention when it is exchanged with a new one.
Figure 3:
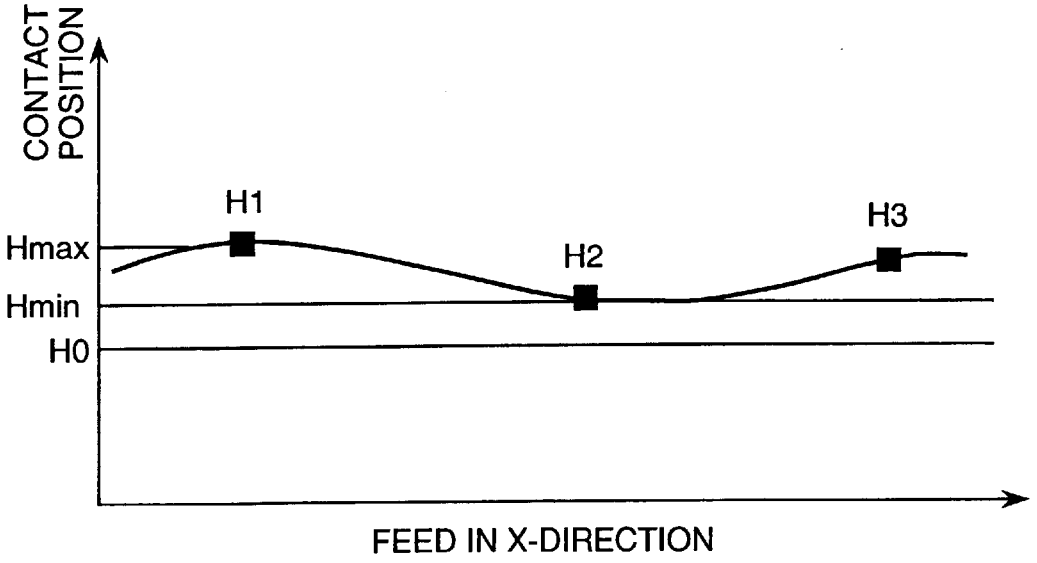
FIG. 3 is a graph explaining a detected result of the surface configuration of the wafer polishing grindstone in accordance with the present invention when it is exchanged with a new one.

FIG. 2 and FIG. 3 are views explaining operation of correcting the surface configuration when the wafer polishing grindstone 4 is exchanged with a new one.

Just after changing the wafer polishing grindstone 4, the surface configuration is sometimes uneven and different from one by one though the average thickness is not different so much. In order to correct the surface configuration to the wafer polishing grindstone 4 in such a state while the position of the grindstone 8 is being appropriately controlled, in the apparatus of the embodiment in accordance with the present invention, contact between the wafer polishing grindstone 4 and the grindstone 8 is sensed at first.

The controller 14 controls switching of a switching part 19 so as to drive the spindle motor 10 using a control part 15 when the contact is sensed. The rotating speed at that time is a speed as slow as barely rotating (for example, several tens rpm) so that the diamond grindstone 8 does not damage the wafer polishing grindstone 4 even if it comes in contact with the wafer polishing grindstone, and is set by a signal of the speed detector 18.

A feeding speed in the cutting direction is set to a speed capable of stopping the motion of the Z-direction moving table 20 or drawing back the Z-direction moving table 20 upward without damaging the wafer polishing grindstone 4 when a speed-down signal or a stop signal is received from the speed detector 18.

An actual surface configuration of the wafer polishing grindstone 4 is detected according to the procedure that initially the X-direction moving table 12 is moved to a position X1, the spindle motor 10 is started to operate in the torque mode as described above, the Z-direction moving table 20 is slowly moved downward, and the Z-direction moving table 20 is suddenly stopped to move when the speed-down signal or stop signal of the spindle motor 10 is detected.

The height H1 of the Z-direction moving table 20 at that time detected by the Z position detector 20 is stored in the controller 14. Then, the Z-direction moving table 20 is returned up to the original height and the X-direction moving table 12 is moved to a position X2 of the next point.

By repeating the operations described above to a point X3, the surface configuration of the wafer polishing grindstone 4 as shown in FIG. 3 can be detected. Therein, number of detecting points in the X-direction, each interval between the points, a height at starting the detecting operation and a feeding speed of the Z-direction moving table 20 may be changed by the controller 14. Since the maximum value Hmax and the minimum value Hmin of the asperities can be obtained by detecting the surface configuration, a height H0 after correction can be set to a position slightly lower than the value Hmin in taking a margin into consideration.

Further, since a cut quantity (Hmax-H0) required for the correcting operation is also obtained, a divided cutting quantity for one scanning in the X-direction is obtained. The divided cutting quantity is a value which does not damage the wafer polishing grindstone 4. The above is the procedure of detecting the surface configuration of the wafer polishing grindstone 4 just after exchanged by a new one before performing the correcting operation. Thus, the status of asperities can be obtained over all the surface of the new wafer polishing grindstone through the detection according to the procedure described above.

The correcting operation of the surface configuration will be described below. The controller 14 instructs the speed control part 16 to drive the spindle motor 10 at a high rotating speed (for example, 10000 rpm) necessary for the correcting operation by controlling the switching part 19. The wafer polishing grindstone 4 is started to be rotated, and a machining liquid (for example, pure water) is supplied.

Next, the controller 14 moves the Z-direction moving table 20 up to the maximum height of Hmax obtained in the preceding paragraph at a high speed, and moved down the Z-direction moving table 20 by the divided cutting quantity obtained in the preceding paragraph, and then the wafer polishing grindstone 4 is cut flat by scanning the X-direction moving table 12 from one end to the other end of the wafer polishing grindstone at a constant speed. By repeating this operation until the height reaches to the height H0 after correction, the wafer polishing grindstone 4 having a very flat surface can be obtained. Since the cutting quantity for once scanning can be set by obtaining the values of Hmax and H0, the grinding can be performed at a high speed by eliminating useless scanning without damaging the wafer polishing grindstone.

In the embodiment of the apparatus in accordance with the present invention, the spindle motor 10 is controlled so that the rotating torque of the spindle motor becomes a predetermined value when the contact between the wafer polishing grindstone 4 and the grindstone 8 is sensed, and so that the rotating speed of the spindle motor becomes a predetermined value while the wafer polishing grindstone is being configured. The reason is that if the rotating speed of the spindle motor is controlled at a constant speed when the contact is sensed, there is a possibility to damage the wafer polishing grindstone 4 because the spindle motor is controlled so as to maintain rotating even if the grindstone 4 comes to contact with the wafer polishing grindstone 8. On the other hand, the reason why the spindle motor is controlled so that the rotating speed of the spindle motor becomes a constant speed while the wafer polishing grindstone is being configured is to obtain a uniform machining accuracy.

Since the cutting depth is set to a value within the range not damage the wafer polishing grindstone 4 in the embodiment of the apparatus in accordance with the present invention, a uniform machining accuracy can be maintained without damaging the wafer polishing grindstone 4.

Finally, the height H0 after correction is stored in the controller 14 as a reference value for the next correcting operation.

By the operation described above, the surface of the wafer substrate 1 can be machined flat with a high accuracy. However, when repeating the machining of the wafer substrate, the wafer polishing grindstone 4 is also machined. As a result, the teeth of the wafer polishing grindstone are filled with ground dust or the surface of the wafer polishing grindstone is deformed, as described above. Therefore, the correcting operation of the wafer polishing grindstone 4 is required again. However, it is clear that the target height value H0' after correction in this case may be determined to be a position slightly lower than the final height H0 in the preceding correcting operation. Description will be made below on the procedure for re-correcting operation based on the information from the preceding correcting operation.

Figure 4:
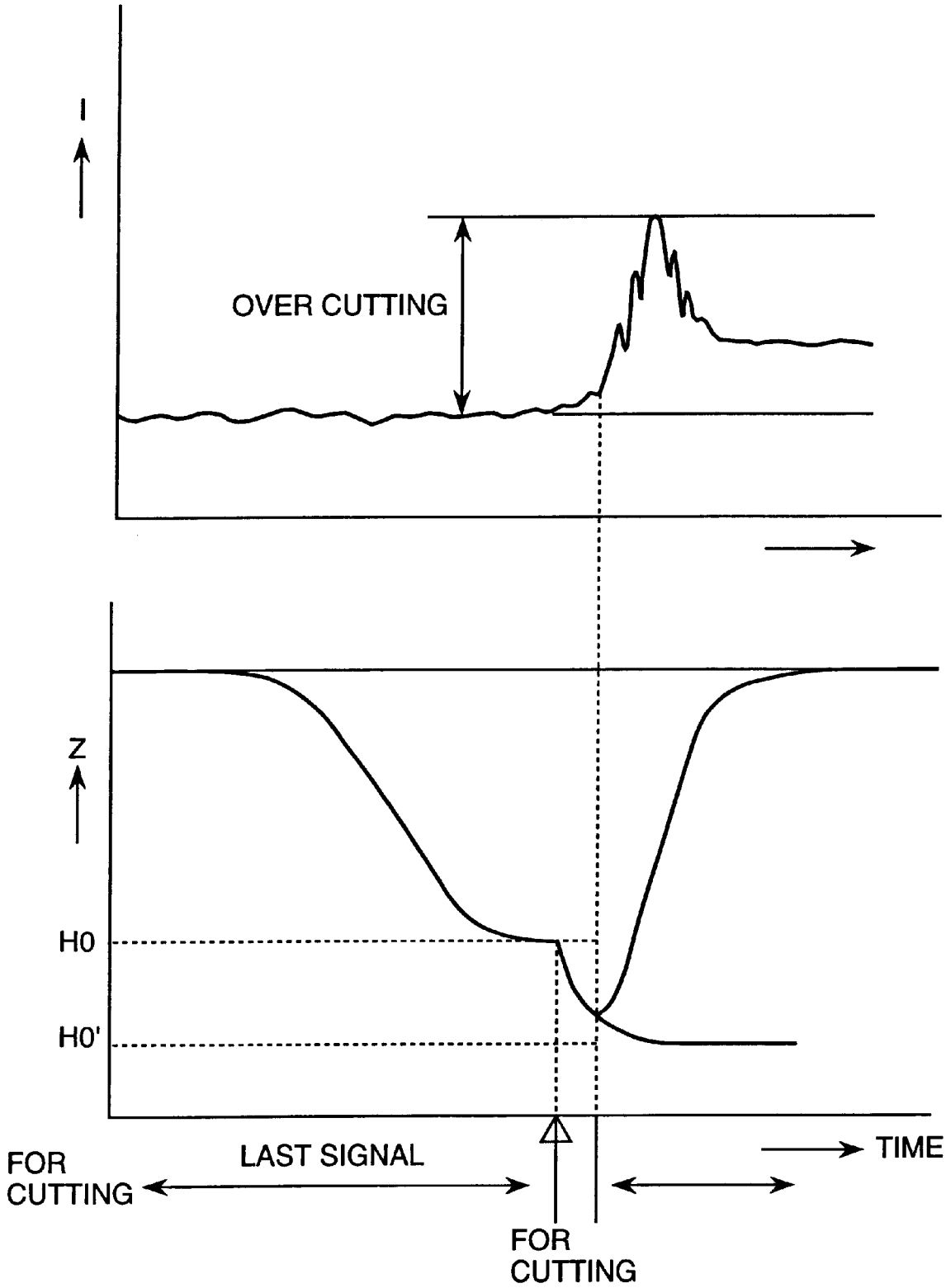
FIG. 4 is a chart explaining operation of avoiding an abnormal cutting in accordance with the present invention.

In the re-correcting operation, the spindle motor 10 is started to be rotated at a rotating speed somewhat slower under the speed control mode from beginning so that change in the load current can be easily detected. Then, the Z-direction moving table 20 is moved down at a high speed as the target value of the final height H0 in the preceding correcting operation. At that time, if the load current is not abnormally increased, the front end of the diamond grindstone 8 is in contact with the surface of the wafer polishing grindstone 4 or is stopped at a positing just before the contact point. After that time, the rotating speed of the spindle motor 10 is returned to a rotating speed for cutting operation to perform correcting operation according to the similar procedure in the preceding correcting operation. After completion of the correcting operation, the final height H0' in this time is stored in the controller 14 again as a reference value of the contact position for the next correcting operation. On the other hand, if the load current of the spindle motor 10 is increased due to some cause while the Z-direction moving table 20 is being fed to the preceding final height H0 for preparation of cutting, as shown in FIG. 4, over cutting may occur to damage the wafer polishing grindstone 4. Therefore, it can be considered that the apparatus comprises a function to prevent the worst case by immediately drawing back the Z-direction moving table 20 in such a case.

As having been described above, according to the present invention, in the polishing apparatus for flattening the surface of the sample such as a semiconductor substrate, surface configuration to a polishing tool for configuring the sample flat can be performed without damaging the polishing tool. Further, the surface configuration can be performed with a high accuracy. Furthermore, the surface configuration can be performed in a high speed.

What is claimed is:

1. A rotary machining apparatus comprising a polishing tool for polishing a sample; a rotary disk for holding said polishing tool; a tool for configuring a surface of said polishing tool; and a position adjusting mechanism for adjusting a gap between said tool and said polishing tool, which comprises:

a rotating mechanism for rotating said tool; and a sensor for sensing a change in the rotation of said rotating mechanism, a height at starting to configure said polishing tool using said tool being determined based on the change in the rotation obtained by said sensor.

2. A rotary machining apparatus according to claim 1, wherein said sensor comprises a function to detect a rotating speed of said rotating mechanism.

3. A rotary machining apparatus according to claim 2, wherein said position adjusting mechanism includes a moving mechanism for adjusting a distance between said tool and said polishing tool, said moving mechanism determining a height at starting configuring based on a change in said rotating speed.

4. A rotary machining apparatus comprising:

a polishing tool rotatably held, said polishing tool being arranged opposite to a sample to be polished;

a tool for configuring a surface of said polishing tool by being rotated by a rotating mechanism, said tool being arranged in a direction perpendicular to the surface of said polishing tool; and a moving mechanism for adjusting a gap between said tool and said polishing tool from a detached state to a contact state, wherein when a change in rotating speed of said rotating mechanism is detected, a position of said moving mechanism is detected.

5. A rotary machining apparatus comprising:

a polishing tool rotatably held, said polishing tool being arranged opposite to a sample to be polished;

a tool for configuring a surface of said polishing tool by being rotated by a rotating mechanism, said tool being arranged in a direction perpendicular to the surface of said polishing tool;

a moving mechanism for moving said tool in the direction perpendicular to the surface of said polishing tool; and a sensor for sensing a rotating speed or a change in rotating torque of said rotating mechanism, wherein contact between said tool and said polishing tool is sensed based on a position of said tool or said moving mechanism when the sensor detects said change in rotating speed.

6. A rotary machining apparatus comprising:

a polishing tool for polishing a sample, said polishing tool being rotatably held;

a tool for configuring a surface of said polishing tool by being rotated by a rotating mechanism, said tool being arranged in a direction perpendicular to the surface of said polishing tool;

a moving mechanism for adjusting a gap between said tool and said polishing tool from a detached state to a contact state; and a sensor for sensing a rotating speed or a change in rotating torque of said rotating mechanism, wherein before configuring said polishing tool using said tool, said tool is brought close to said polishing tool by movement of said moving mechanism by being rotated at a rotating speed slower than a rotating speed of said rotating mechanism during configuring, and a starting point of configuring said polishing tool by said tool is determined based on the rotating speed or the change in rotating torque sensed by said sensor at that time.

7. A rotary machining apparatus according to claim 6, which comprises a controller for controlling a rotating speed of said rotating mechanism to a predetermined value when said polishing tool is configured, and controlling a value of torque of said rotating mechanism to a predetermined value when contact between said tool and said polishing tool is sensed.

8. A rotary machining apparatus comprising:

a polishing tool for polishing a sample, said polishing tool being rotatably held;

a tool for configuring a surface of said polishing tool by being rotated by a rotating mechanism, said tool being arranged in a direction perpendicular to the surface of said polishing tool;

a moving mechanism for adjusting a gap between said tool and said polishing tool from a detached state to a contact state; and a sensor for sensing a rotating speed or a change in rotating torque of said rotating mechanism, wherein before configuring said polishing tool using said tool, said tool is brought close to said polishing tool by movement of said moving mechanism by being rotated at a rotating speed slower than a rotating speed of said rotating mechanism during configuring, and contact between said tool and said polishing tool is sensed based on the rotating speed or the change in rotating torque sensed by said sensor at that time.

* * * * *